United States Patent [19]

Cawley

[11] Patent Number: 4,540,336

[45] Date of Patent: Sep. 10, 1985

[54] OXIDIZING SEAL FOR A TURBINE TIP GAS PATH

[75] Inventor: James D. Cawley, Cleveland Hts., Ohio

[73] Assignee: The United States of America as represented by the Administrator of the National Aeronautics and Space Administration, Washington, D.C.

[21] Appl. No.: 602,050

[22] Filed: Apr. 19, 1984

[51] Int. Cl.[3] ..... F01D 11/08

[52] U.S. Cl. ..... 415/174; 415/170 R; 415/196; 415/200; 416/174

[58] Field of Search ..... 415/174, 170 R, 196, 415/200, 197, 9, 172 A; 416/174; 277/53, DIG. 6, 96.2; 428/614

[56] References Cited

U.S. PATENT DOCUMENTS

| | | | |
|---|---|---|---|
| 3,883,147 | 5/1975 | Troy et al. | 277/96.2 |
| 4,149,823 | 4/1979 | Zboril | 415/200 |
| 4,202,928 | 5/1980 | Staebler | 428/446 |
| 4,336,276 | 6/1982 | Bill et al. | 415/174 |
| 4,337,476 | 6/1982 | Fraser et al. | 428/446 |
| 4,377,371 | 3/1983 | Wisander et al. | 415/197 |

*Primary Examiner*—Robert E. Garrett
*Assistant Examiner*—John Kwon
*Attorney, Agent, or Firm*—Gene E. Shook; John R. Manning

[57] ABSTRACT

The sealing of the gas path in a gas turbine engine at the blade tips is improved by maintaining a minimum clearance between the rotor blade tips and the gas path seal. This is accomplished by taking advantage of an increase in volume during controlled oxidation of certain intermetallic compounds which have high melting points.

The increase in volume closes the clearance subsequent to a rub between the blades and the seal. Thus, these compounds re-form the tip seal surface to assure continued engine efficiency.

13 Claims, 4 Drawing Figures

OXIDIZING SEAL FOR A TURBINE TIP GAS PATH

ORIGIN OF THE INVENTION

The invention described herein was made by an employee of the U.S. Government and may be manufactured and used by or for the Government for governmental purposes without the payment of any royalties thereon or therefor.

TECHNICAL FIELD

In a gas turbine engine there is a pressure differential across the turbine rotor. The engine performance is improved if this differential is maintained at a high level. In order to achieve this desired result the clearance between the rotor tips and the gas path seal must be kept to a minimum.

A consequence of these close clearances is that there is a high probability of a rubbing interaction between the turbine blades and the seal. Any wear that occurs during a rub increases the clearances and decreases the obtainable differential in pressure.

Seals in present day systems utilize materials that are stable in an oxidizing atmosphere, and these materials wear preferably to the tubine blades. The result of a rub in this configuration is that of material being swept out of the seals during the rub. The penalty in this event is permanent and cumulative, though less than if the rotor had received the wear.

It is, therefore, an object of the present invention to provide an improved gas path seal for a gas tubine engine having the ability to reform the tip seal surface subsequent to a rub to restore and maintain a minimum clearance.

BACKGROUND ART

Watkins, Jr. et al. U.S. Pat. No. 4,063,742 and Bill et al. U.S. Pat. No. 4,295,786 are directed to seals having compliant backing structures which provide for deformation to reduce abrasion. In the Watkins, Jr. patent the seal uses a series of thin narrow elongated metal strips to accommodate deformation while the Bill et al. patent discloses a gas path seal made of a thin layer of a deformable, metallic material such as aluminum.

Schilke et al. U.S. Pat. No. 3,817,719 discloses a porous abradable material used in gas turbine seals. The disclosed material is formed through an oxidizing step, but the resulting product is resistant to oxidation.

Panzera U.S. Pat. No. 4,080,204 describes an abradable seal for a turbine made from various alloys. The preferred alloy includes 20–27% nickel, 18–22% chromium, and 9–15% aluminum, with a trace of yttrium. The materials described in both the Panzera patent and the Schilke et al. patent can be operated only at relative low temperatures below about 2000° F.

DISCLOSURE OF INVENTION

This invention is concerned with improving the sealing of the gas path at the tubine blade tip. This is accomplished by taking advantage of an increase in volume during controlled oxidation of certain intermetallic compounds.

These materials have high melting points. The increase in volume is relied on to close the clearances subsequent to a rub. In effect, these materials re-form the tip seal surface to assure continued engine efficiency.

BRIEF DESCRIPTION OF THE DRAWINGS

The objects, advantages, and novel features of the invention will be more fully apparent from the following detailed description when read in connection with the accompanying drawings in which.

BEST MODE FOR CARRYING OUT THE INVENTION

Figure 1:
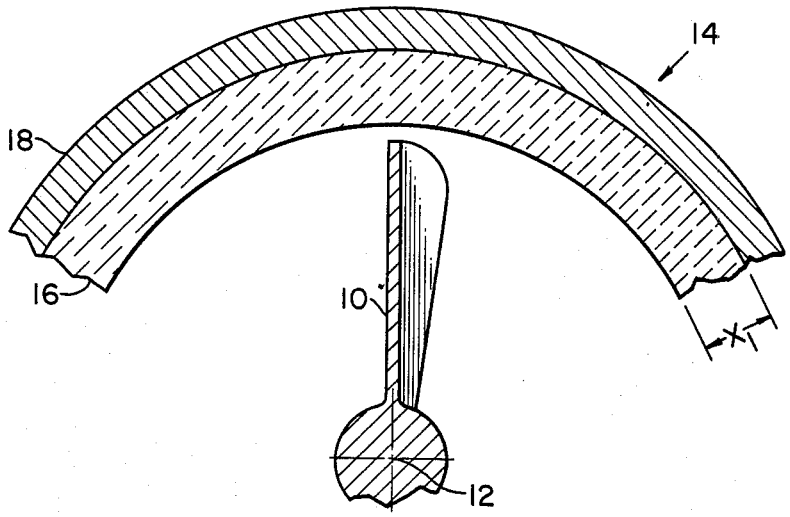
FIG. 1 is a schematic view of a transverse cross section of an arrangement for a turbine or a compressor shroud having an improved seal constructed in accordance with the present invention.

Referring now to the drawing a rotor blade 10 of a turbine rotates about an axis 12 in a counter-clockwise direction as shown in FIG. 1. The fluid in which it operates flows in a direction into the paper. A shroud 14 surrounds the blade 10 and is substantially concentric with the axis 12. The shroud 14 includes an oxide layer 16 of a material 18 that is oxidizable. The surface of the oxide layer 16 is aerodynamically smooth and closely spaced to the blade tips.

A sprayed coating of the material 18 on the inside surface of the turbine housing or casing (not shown) has been found to be suitable for forming a seal between the tip of the rotor blade 10 and the shroud 14. The material 18 may be deposited on the turbine housing by any of a number of conventional methods, such as spray coating, sintering, etc. to form a substrate that is subsequently oxidized.

It is further contemplated that the material 18 may not be deposited on the turbine housing in certain installations. The entire shroud 14 may be fabricated from a sheet or sheets of the material 18.

This invention is concerned with the material 18 utilized to form the oxide layer 16. Many materials exhibit parabolic oxidation kinetics. In this invention the oxide thickness may be described by the equation (1)$x^2=K_pt$ or $x=\sqrt{K_pt}$. In this expression, x is the oxide thickness shown in the drawings, t is the time, and $K_p$ is a material property termed the parabolic rate constant.

The rate of oxide growth, dx/dt, decreases with oxidation time, or equivalently oxide thickness.

$$\frac{dx}{dt} = \frac{1}{2}\sqrt{\frac{K_p}{t}} = \frac{1}{2}\frac{K_p}{x} \qquad (2)$$

Many materials exhibit a volume change upon oxidation. By way of example, a general intermetallic compound is identified as $A_pB_q$, where A and B represent metallic elements, and p and q are integers. In order to simplify the mathematics, the assumption is made that the oxide of one of the species is dominant; B forms $B_sO_t$. This assumption is made only for convenience; the principle also holds for multi-phase oxidation.

Figure 4:
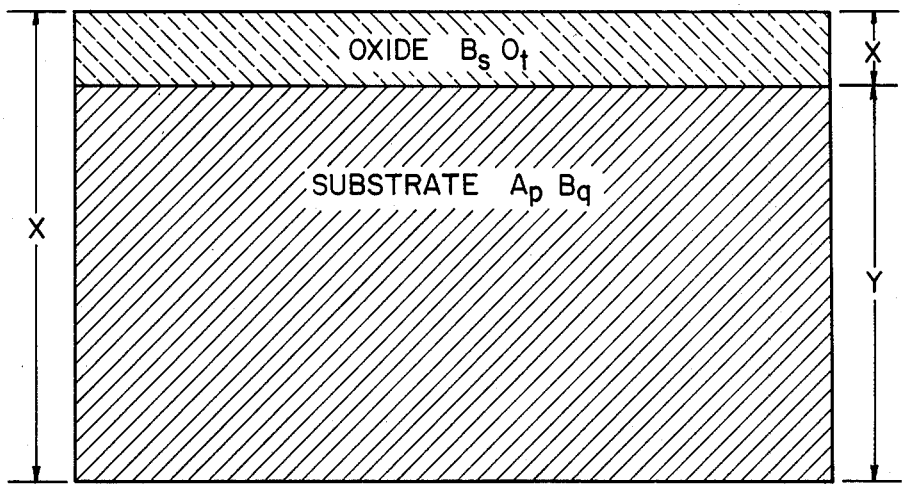
FIG. 4 is a cross-section view illustrating an oxidizing intermetallic material.

When the material is oxidized, dimensional changes may occur. These are dependent upon the relative densities of the oxide and the intermetallic compound. Such a system is shown in FIG. 4. Defining x as the thickness of the $B_sO_t$ oxide, y as the thickness of intermetallic substrate, and X as the overall thickness of the system, a number of relationships may be set forth. For example, the overall dimensional change is the sum of the changes in the thicknesses of oxide and substrate.

$$\frac{dX}{dt} = \frac{dx}{dt} + \frac{dy}{dt} \tag{3}$$

If there is no external source of B and no evaporation of B occurs, then the number of moles of B in the system is constant $$\frac{dM_{system}}{dt} = 0 \tag{4}$$

where $M_i$ is the number of moles of B in the ith phase therefore $$\frac{dM_{oxide}}{dt} + \frac{dM_{substrate}}{dt} = 0$$

or $$\frac{dM_{oxide}}{dt} = \frac{dM_{substrate}}{dt} \tag{5}$$

The amount of B entering the oxide is $$\frac{dM_{oxide}}{dt} = N_{oxide}\frac{dV_{oxide}}{dt} \tag{6}$$

where $N_i$ is the fractional molar density of B in the ith phase (Mol/M$^3$). $V_i$ is the volume of ith phase (m$^3$), while the amount leaving the substrate is $$\frac{dM_{substrate}}{dt} = N_{substrate}\frac{dV_{substrate}}{dt} \tag{7}$$

Therefore, it is possible to obtain an expression for the dimensional change of system in terms of the oxide growth rate.

Equating equations 6 and 7 results in the expression $$N_{oxide}\frac{dV_{oxide}}{dt} = -N_{substrate}\frac{dV_{substrate}}{dt}$$

When the cross sectional area is constant, this may be rewritten as $$N_{oxide}\frac{dx}{dt} = -N_{substrate}\frac{dy}{dt} \tag{8}$$

Solving for substrate dimensional change, dy/dt, and substituting into equation 3 results in the expression $$\frac{dX}{dt} = \left(1 - \frac{N_{oxide}}{N_{substrate}}\right)\frac{dx}{dt} \tag{9}$$

The fraction molar concentrations can, in turn, be written as $$N_i = \frac{\rho_i}{W_i}C_i$$

where $C_i$ is the fraction of B in the ith phase $\rho_i$ is the density of the ith phase (g/m$^3$)

$\omega_i$ is the molecular weight of the ith phase (g/mol)

Therefore, equation 8 may be rewritten as $$\frac{dX}{dy} = \left(1 - \frac{P_{oxide}}{P_{substrate}} \cdot \frac{W_{substrate}}{W_{oxide}} \cdot \frac{C_{oxide}}{C_{substrate}}\right)\frac{dx}{dt}$$

Because these are all material constants, a composite constant may be defined $$\beta = \frac{P_{oxide}}{P_{substrate}} \cdot \frac{W_{substrate}}{W_{oxide}} \cdot \frac{C_{oxide}}{C_{substrate}} \tag{10}$$

From this definition it is apparent that when the composite constant is less than one, the overall thickness increases with increasing oxidation. When the composite constant is greater than one, the overall thickness would decrease.

Figure 2:
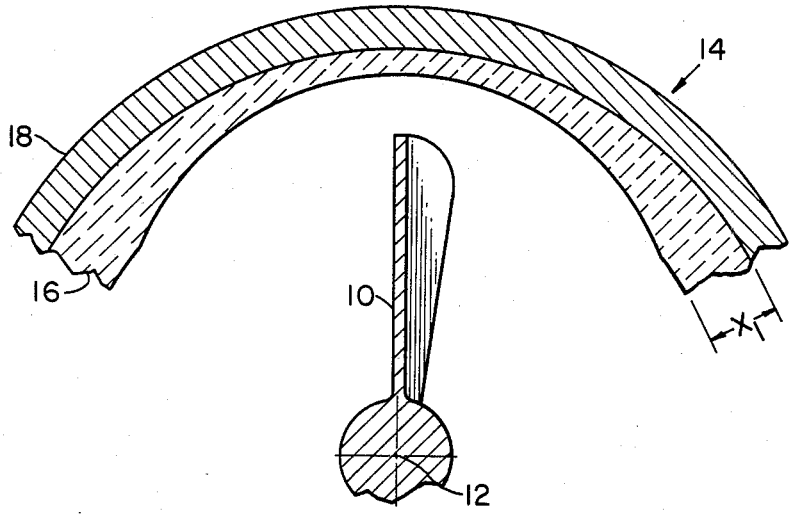
FIG. 2 is a schematic view in transverse cross-section of the seal shown in FIG. 1 immediately after rubbing.

According to the present invention the seal material 18 is oxidized prior to installation for a given time, $t_1$, at a given temperature, $T_1$, to produce an oxide layer 16 having a thickness of $x_1$ as shown in FIG. 1. In the event of a rub which abrades the oxide, a gradient in oxide thickness is produced as shown in FIG. 2. The region of the seal which lost material during the rub is an intermetallic compound protected by a thinner amount of oxide. The result is that this material will oxidize faster, as can be seen in equation 2 above.

Figure 3:
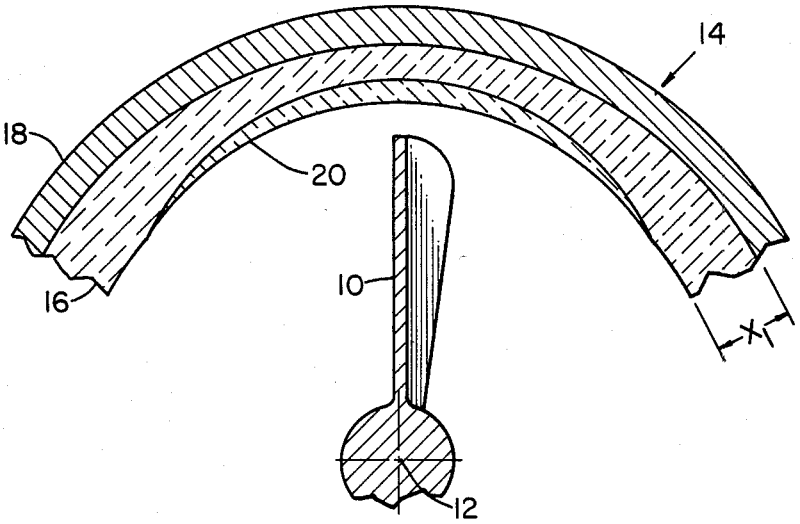
FIG. 3 is a transverse cross-section of the seal shown in FIG. 2 after a period of time has elapsed subsequent to the rubbing showing the post rub oxide growth filling in the rub area.

Any volume change which oxidation produces will occur to a greater extent in the rub area. In the case of a positive volume change, the rubbed area will tend to be filled in, as schematically shown at 20 in FIG. 3. The amount that can be recovered is dependent on the value of the constant defined in equation 10. The rate at which recovery takes place is dependent on the value of the parabolic rate constant, $K_p$ in equation 1.

This type of post rub dimensional change can be effected through the use of any material which forms an adherent oxide film. One class of materials which have properties suitable for the oxidizing seal of the present invention is the silicides. These materials include silicides of molybdenum, tungsten, tantalum, titanium, and boron. All have high melting points and are silica formers. During oxidation an adherent layer of $SiO_2$ is formed through which diffusion must take place for further oxidation.

A positive volume increase also occurs. For example, in $MoSi_2$ the composite constant in equation 10 is $$\beta = \frac{2.26\ (g/cm^3)}{6.26\ (g/cm^3)} \times \frac{152.12\ (g/mol)}{60.09\ (g/mol)} \times \frac{0.\bar{3}}{0.\bar{6}} = 0.457$$

Equation 9 for $MoSi_2$ undergoing oxidation, then, is $$\frac{dX}{dt} = 0.543\frac{dx}{dt} \tag{11}$$

Therefore, the overall thickness increases at over half the rate of oxidation.

It should also be noted that the incorporation of porosity, as a second phase, in the oxide will decrease the value of the composite constant, $\beta$, because the effective oxide density will be lower. Also, if the oxide is being formed on a concave surface, as in a gas turbine seal of the type shown in FIG. 1, the radial change will be greater than equation 11 predicts because the cross-sectional area decreases with decreasing radial distance.

While the preferred embodiment of the invention has been shown and described, it will be appreciated that various structural modifications may be made without departing from the spirit of the invention or scope of the subjoined claims.

I claim:

1. In a gas path seal for a turbine or the like having a plurality of blades mounted for rotation about an axis, an improved shroud surrounding the tips of said blades in substantially concentric relationship to said axis, said shroud comprising an annular substrate of an oxidizable intermetallic compound of a silicide having a high melting point spaced from the tips of said blades, and an oxide layer of silica that is abradable relative to said blades and closely spaced to said blade tips covering said intermetallic compound to form a seal surface so that said oxide layer abrades in a rub area on said surface when said blades contact said layer thereby reducing the thickness of said layer in said rub area whereby said intermetallic compound adjacent to said rub area oxidizes to reform the seal surface.

2. A gas path seal as claimed in claim 1 wherein the intermetallic compound is a silicide of molybdenum.

3. A gas path seal as claimed in claim 1 wherein the intermetallic compound is a silicide of tungstun.

4. A gas path seal as claimed in claim 1 wherein the intermetallic compound is a silicide of tantalum.

5. A gas path seal as claimed in claim 1 wherein the intermetallic compound is a silicide of titanium.

6. A gas path seal as claimed in claim 1 wherein the intermetallic compound is a silicide of boron.

7. A gas path seal for a turbine or the like having a plurality of blades mounted for rotation about an axis comprising a stator shroud having an aerodynamic smooth surface on an oxide layer of a high melting point silica that is oxidizable, said oxide layer being wearable relative to said blade tips whereby a portion of said oxide layer is removed in a rub area of said surface thereby reducing the thickness of said layer in said rub area when said blades rub against said surface, and a substrate of an oxidizable intermetallic compound of a silicide in contact with said oxide layer at least in said rub area so that said intermetallic compound in said substrate adjacent to said rub area oxidizes to reform said surface.

8. A gas path seal as claimed in claim 7 wherein the intermetallic compound is a silicide of molybdenum.

9. A gas path seal as claimed in claim 7 wherein the intermetallic compound is a silicide of tungsten.

10. A gas path seal as claimed in claim 7 wherein the intermetallic compound is a silicide of tantalum.

11. A gas path seal as claimed in claim 7 wherein the intermetallic compound is a silicide of titanium.

12. A gas path seal as claimed in claim 7 wherein the intermetallic material is a silicide of boron.

13. A gas path seal for a turbine or the like having a plurality of blades mounted for rotation about an axis comprising a stator shroud having an aerodynamic smooth surface on an oxide layer of a high melting point material that is oxidizable, said oxide layer being wearable relative to said blade tips whereby a portion of said layer is removed in a rub area of said surface thereby reducing the thickness of said layer in said rub area when said blades rub against said surface, and a substrate of an intermetallic compound of a material whose oxide exhibits parabolic growth in contact with said oxide layer at least at said rub area so that said material in said substrate adjacent to said rub area oxidizes to reform said surface.

* * * * *